United States Patent [19]

Sakai et al.

[11] 3,966,516

[45] June 29, 1976

[54] SLURRY EXPLOSIVE COMPOSITION CONTAINING A NITROPARAFFIN AND AN AMIDE

[75] Inventors: Hiroshi Sakai; Fumio Takeuchi; Tsutomu Hanake, all of Aichi, Japan

[73] Assignee: Nippon Oils and Fats Company Limited, Tokyo, Japan

[22] Filed: June 18, 1975

[21] Appl. No.: 588,052

[30] Foreign Application Priority Data

June 25, 1974 Japan ..... 49-72599

[52] U.S. Cl. ..... 149/60; 149/61; 149/75; 149/82; 149/83; 149/85; 149/89

[51] Int. Cl.[2] ..... C06B 31/30

[58] Field of Search ..... 149/75, 89, 83, 76, 149/60, 85, 82, 61

[56] References Cited

UNITED STATES PATENTS 3,275,485 9/1966 Egly ..... 149/89

*Primary Examiner*—Stephen J. Lechert, Jr.
*Attorney, Agent, or Firm*—Stevens, Davis, Miller & Mosher

[57] ABSTRACT

A slurry explosive composition comprising an inorganic oxidizing acid salt, water, a combustible material, a thickener, a nitroparaffin and an amide is very sensitive and stable, and can be detonated at low temperature without the use of primer.

9 Claims, No Drawings

SLURRY EXPLOSIVE COMPOSITION CONTAINING A NITROPARAFFIN AND AN AMIDE

The present invention relates to a slurry explosive composition having high ignition sensitivity, high explosive power and high detonation velocity, which is compounded with a nitroparaffin and an amide.

A large number of slurry explosive compositions compounded with TNT and other nitro compounds as a sensitizer have hitherto been developed. However, nitro compounds are insoluble in water and many of nitro compounds are solid at room temperature, and therefore the nitro compounds are merely dispersed in the slurry explosive composition in the form of a fine particle. When such slurry explosive composition is stored for a long time or kept at low temperature, crystals of the nitro compound grow or ammonium nitrate crystallizes out to separate the grown nitro compound, and the sensitivity of the slurry explosive composition becomes very poor.

In order to obviate these drawbacks, various methods have been disclosed. For example, in Japanese Patent Application Publication No. 15,800/71, 0.1–5% by weight of higher alkylamine or other surfactants is compounded into a TNT slurry explosive composition, whereby the crystallization of ammonium nitrate is prevented to retard the separation of ammonium nitrate from TNT. In U.S. Pat. No. 2,930,685, 1–25% by weight of sodium nitrate or urea is compounded into a TNT slurry explosive, whereby the melting point of the explosive is lowered.

U.S. Pat. No. 3,546,034 discloses a slurry explosive composition containing 20–30% by weight of nitromethane as a sensitizer and 4–7% by weight of urea as a crystallization temperature-lowering agent for ammonium nitrate at low temperature. In this U.S. Pat. No. 3,546,034, the 20–30 parts by weight of nitromethane contained in the explosive composition are gelatinized by using 1.5–2.0 parts by weight of nitrocellulose, and the gelatinized nitromethane is dispersed in the gum contained in the explosive composition, whereby the nitromethane is solidified in the explosive composition. Moreover, in this U.S. Patent, urea is merely used for lowering the crystallization temperature of ammonium nitrate. In this U.S. Patent, the problem of aggregation of nitromethane at low temperature is solved by solidifying nitromethane and by lowering the crystallization temperature of ammonium nitrate, but all of the slurry explosive compositions described in the examples of this U.S. Patent are not ignited by No. 8 detonator in spite of the presence of 20–30% by weight of nitro compound in the explosive composition, and completely detonate with 10–40g of a particular booster (a mixture of trimethylenetrinitramine and plasticizer). That is, the problem of sensitivity of explosive at low temperature is not at all solved in U.S. Pat. No. 3,546,034.

The present invention aims to solve the problems which have not been solved by the above described patents. That is, in the present invention, a nitroparaffin is contained in a slurry explosive composition as a sensitizer, and the nitroparaffin is dissolved in an amide to lower the crystallization temperature of ammonium nitrate, to prevent the aggregation of the sensitizer and to decrease the necessary amount of water to be compounded into the explosive composition, whereby the lowering of sensitivity and power of the slurry explosive composition due to the long time storage and the keeping at low temperature is prevented and the detonation velocity of the explosive composition is increased.

The slurry explosive composition of the present invention comprises an inorganic oxidizing acid salt, water, a combustible material and a thickener, and further a nitroparaffin as a sensitizer and an amide which acts as a solubilizing agent for the sensitizer and as a crystallization temperature-lowering agent for ammonium nitrate.

The inorganic oxidizing acid salt includes ammonium, alkali metal and alkaline earth metal salts of inorganic oxidizing acids, such as nitric acid, chloric acid, hypochlorous acid, perchloric acid and the like, and their mixtures. The inorganic oxidizing acid salt is contained in an amount of 40–80% by weight based on the total amount of the explosive composition.

Water is contained in an amount of 7–25% by weight based on the total amount of the explosive composition.

The combustible material includes liquid combustible materials, such as ethylene glycol and light oil and other fuel oils, and solid combustible materials, such as powdery sulfur, powdery coal and the like, and their mixtures. The combustible material is contained in an amount of 0–15% by weight based on the total amount of the explosive composition.

The thickener includes natural and synthetic high polymers, such as guar gum, polyacrylamide and the like, and their mixtures. The thickener is contained in an amount of 0.5–5% by weight based on the total amount of the explosive composition.

In the present invention, a small amount of surfactant may be contained in the explosive composition, if desired. As the surfactant, ampholytic surfactants, such as dimethylalkyl(coconut oil)-betaine and the like, are preferably used.

Nitroparaffin is an effective sensitizer. In the present invention, nitroparaffins, such as nitromethane, nitroethane, nitropropane and other nitroparaffins, are used alone or in admixture. Among them, nitroparaffins having 1–3 carbon atoms are preferably used. The nitroparaffin is contained in an amount of 3–30% by weight based on the total amount of the explosive composition.

The slurry explosive composition of the present invention further contains amides, such as formamide, acetamide, N,N-dimethylformamide and the like, and their mixtures, which act as a solubilizing agent for nitroparaffin and as a crystallization temperature-lowering agent for ammonium nitrate. The amide is contained in an amount of 5–15% by weight based on the total amount of the explosive composition.

The amide, particularly formamide, to be used in the present invention has hitherto been known as a dispersing agent for nitro compounds. The inventors have newly found that the amide further acts as a solubilizing agent for nitroparaffin and that the amide is not inferior to urea in the ability for lowering the crystallization temperature of ammonium nitrate.

That is, the amide can prevent the aggregation of nitroparaffin, the crystallization of ammonium nitrate and the separation of nitroparaffin from the crystals of ammonium nitrate, which occur at low temperature or after long time storage, and can improve the sensitivity of explosives.

In the present invention, the surfactant is used not only in order to form very fine cells in the explosive, but also in order to make ammonium nitrate deposited after long time storage or during keeping at low temperature more uniform or fine as compared with an explosive composition containing no surfactant. As the result, the deterioration of the performance of explosive at low temperature or after long time storage can be prevented.

A method for producing the slurry explosive composition of the present invention will be explained hereinafter.

Into a mixer equipped with a stirrer are charged water, an amide (for example, formamide) and a nitroparaffin, and the resulting mixture is stirred thoroughly to form a homogeneous solution, to which an inorganic oxidizing acid salt is added, and the resulting mixture is stirred at 40°–50°C to dissolve the acid salt into the solution. Then, a surfactant is added to the solution, and the resulting mixture is stirred for several minutes. The mass is added with a mixture of a thickener and a liquid combustible material such as ethylene glycol or the like, and stirred until the viscosity of the mass becomes sufficiently high to obtain a slurry explosive composition.

The following examples are given for the purpose of illustration of this invention and are not intended as limitations thereof.

EXAMPLES 1–7 AND COMPARATIVE EXAMPLES 1–3

Slurry explosive compositions of Examples 1–7 and Comparative Examples 1–3, each having a composition shown in the following Table 1, were produced according to the above described production method. The detonation velocity of the resulting explosive composition was measured at 20°C, 10°C and 0°C in a steel tube having a diameter of 35 mm according to JIS K4810 method. In this test, the explosive composition was initiated by the use of No. 6 detonator alone or together with a primer of 50g of an ammonium nitrate gelatine (trademark: Sugi dynamite) or 2g of a plate-shaped explosive composed of 70% by weight of trimethylenetrinitramine and 30% by weight of a plasticizer. The composition and the performance of the explosive compositions are shown in Table 1.

Table 1

| | | Comparative Example | | | Example | | | | | | |
|---|---|---|---|---|---|---|---|---|---|---|---|
| | | 1 | 2 | 3 | 1 | 2 | 3 | 4 | 5 | 6 | 7* |
| Composition(% by weight) | | | | | | | | | | | |
| Ammonium nitrate | | 75.46 | 75.49 | 70.46 | 70.46 | 70.46 | 70.46 | 70.48 | 70.48 | 70.50 | 65.48 |
| Formamide | | 9.0 | 9.0 | 9.0 (urea) | 9.0 | 9.0 | 9.0 | 9.0 | 9.0 | 9.0 | 9.0 |
| Ethylene glycol | | 5.0 | 5.0 | 5.0 | 5.0 | 5.0 | 5.0 | 5.0 | 5.0 | 5.0 | 5.0 |
| Water | | 10.0 | 10.0 | 10.0 | 10.0 | 10.0 | 10.0 | 10.0 | 10.0 | 10.0 | 10.0 |
| Guar gum | | 0.5 | 0.5 | 0.5 | 0.5 | 0.5 | 0.5 | 0.5 | 0.5 | 0.5 | 0.5 |
| Dimethylalkyl(coconut oil)-betaine | | 0.04 | 0.01 | 0.04 | 0.04 | 0.04 | 0.04 | 0.02 | 0.02 | — | 0.02 |
| Nitromethane | | — | — | 5.0 | 5.0 | — | — | 5.0 | — | 5.0 | 3.23 |
| Nitroethane | | — | — | — | — | 5.0 | — | — | 5.0 | — | 2.42 |
| 1-Nitropropane | | — | — | — | — | — | — | — | — | — | 2.42 |
| 2-Nitropropane | | — | — | — | — | — | 5.0 | — | — | — | 1.93 |
| Bulk density | | 1.00 | 1.13 | 1.11 | 1.01 | 1.12 | 1.18 | 1.15 | 1.17 | 1.18 | 1.19 |
| Detonation velocity(m/sec) | | | | | | | | | | | |
| Initiation by using 50g of Sugi dynamite as a primer | 20°C | 4,460 | not detonated | 4,780 | 4,780 | 4,820 | 4,800 | 4,600 | 5,280 | 5,090 | 5,160 |
| | 10°C | 4,050 | " | 4,510 | 4,530 | 4,320 | 4,200 | 4,860 | 4,570 | 4,730 | 4,680 |
| | 0°C | 3,680 | " | 3,950 | 4,050 | 3,960 | 3,600 | 4,320 | 4,040 | 4,560 | 4,210 |
| Initiation by using 2g of a plate-shaped explosive as a primer | 20°C | 4,230 | " | 4,340 | 4,430 | 4,320 | 4,200 | 5,030 | 4,520 | 4,920 | 4,930 |
| | 10°C | 3,200 | " | 3,570 | 4,030 | 3,980 | 3,600 | 4,690 | 4,170 | 4,580 | 4,340 |
| | 0°C | not detonated | " | 3,010 | 3,660 | 3,470 | 3,150 | 4,200 | 3,690 | 4,010 | 4,000 |
| Initiation by No. 6 detonator alone | 20°C | " | " | not detonated | 3,890 | 3,620 | 3,280 | 4,080 | 3,910 | 3,940 | 3,970 |
| | 10°C | " | " | " | 3,230 | 3,100 | 3,050 | 3,690 | 3,520 | 3,580 | 3,630 |

*In Example 7, a mixed nitroparaffin is used.

Comparative Example 1 shows an explosive composition containing no nitroparaffin. The explosive composition completely detonated at 0°C by the use of 50g of Sugi dynamite as a primer. However, the explosive composition did not detonate at 0°C by the use of 2g of a plate-shaped explosive as a primer. The explosive composition did not detonate even at room temperature by No. 6 detonator alone. Comparative Example 2 shows an explosive composition having the same composition as that of Comparative Example 1, except that the amount of the surfactant is decreased to 0.01% by weight. The bulk density of this explosive composition increased to 1.13, but the explosive composition did not detonate at 20°C even by the use of 50g of Sugi dynamite as a primer. Comparative Example 3 shows an explosive composition having the same composition as that of Example 1, except that formamide is replaced with urea. The explosive composition had a sensitivity considerably lower than that of the explosive composition of Example 1 and did not detonate even at room temperature (20°C) by No. 6 detonator alone.

Examples 1, 2 and 3 show explosive compositions, in which 5 parts by weight of ammonium nitrate in the explosive composition of Comparative Example 1 is replaced with 5 parts by weight of nitromethane, nitroethane or nitropropane. These explosive compositions completely detonated at 10°C by No. 6 detonator alone. This shows that the explosive compositions are remarkably sensitized.

Examples 4 and 5 show explosive compositions containing a decreased amount, i.e., 0.02% by weight of a surfactant. Due to the decrease of the amount of surfactant, the bulk density of the explosive compositions was somewhat increased. The explosive compositions of Examples 4 and 5 had substantially the same detonation velocity as that of the explosive compositions of Examples 1, 2 and 3.

Example 6 shows an explosive composition containing no surfactant. The explosive composition was somewhat higher than the explosive composition containing a surfactant in the bulk density and was substantially the same as the latter explosive composition in the detonation velocity.

Example 7 shows an explosive composition containing 10% by weight of a mixed nitroparaffin composed of 32.3% by weight of nitromethane, 24.2% by weight of nitroethane, 24.2% by weight of 1-nitropropane and 19.3% by weight of 2-nitropropane, which is obtained by nitrating propane at 790°–795°C. The explosive composition detonated even at 10°C by No. 6 detonator alone.

It can be seen from the above results that the addition of nitroparaffin and formamide into an explosive improves the detonability of the explosive even at low temperature and after long time storage.

What is claimed is:

1. A slurry explosive composition comprising an inorganic oxidizing acid salt, water, a combustible material, a thickener, a nitroparaffin and an amide.

2. An explosive composition according to claim 1, wherein said explosive composition further contains a surfactant.

3. An explosive composition according to claim 1, wherein said nitroparaffin is at least one of nitroparaffins having 1–3 carbon atoms.

4. An explosive composition according to claim 1, wherein said amide is at least one member selected from the group consisting of formamide, acetamide and N,N-dimethylformamide.

5. An explosive composition according to claim 1, wherein said inorganic oxidizing acid salt is at least one member selected from the group consisting of ammonium, alkali metal and alkaline earth metal salts of nitric acid, chloric acid, hypochlorous acid and perchloric acid.

6. An explosive composition according to claim 1, wherein said combustible material is at least one member selected from the group consisting of liquid combustible materials, such as ethylene glycol and light oil and other fuel oils, and solid combustible materials, such as powdery sulfur and powdery coal.

7. An explosive composition according to claim 1, wherein said thickener is at least one member selected from the group consisting of natural and synthetic high polymers, such as guar gum and polyacrylamide.

8. An explosive composition according to claim 2, wherein said surfactant is ampholytic surfactant.

9. An explosive composition according to claim 8, wherein said ampholytic surfactant is dimethylalkyl(-coconut oil)-betaine.

* * * * *